United States Patent [19]

Brown

[11] 4,186,897

[45] Feb. 5, 1980

[54] WIRE CONTROL MECHANISM

[76] Inventor: Maurice H. Brown, 11655 S. Mayfield, Worth, Ill. 60482

[21] Appl. No.: 929,658

[22] Filed: Jul. 31, 1978

[51] Int. Cl.[2] ..... B65H 59/06

[52] U.S. Cl. ..... 242/147 R; 242/128

[58] Field of Search ..... 242/47.01, 128, 147 R, 242/129.8, 149; 57/59, 34 R, 58.83, 58.86, 352, 354

[56] References Cited

U.S. PATENT DOCUMENTS

| | | | |
|---|---|---|---|
| 3,498,564 | 3/1970 | Dismon | 242/128 |
| 3,995,786 | 12/1976 | Deniega | 242/47.01 |

*Primary Examiner*—Stanley N. Gilreath
*Attorney, Agent, or Firm*—Kinzer, Plyer, Dorn & McEachran

[57] ABSTRACT

A device for applying tension to wire, especially wire of fine diameter as it is unwound at high speeds over an axial end of a spool of wire. The tensioning device is effective to prevent curling and twisting of the wire as it is unwound. It is also useful in tensioning wire during high speed winding where the wire is rapidly accelerated and decelerated. The wire control device includes a disc having a plurality of radially extending filaments which protrude beyond the periphery of the axial end of the spool of wire and engage the wire as it is unwound over the axial end of the spool. A cylindrical shaped tubular member encircles the disc and engages the ends of the filaments to bend them so that they extend in a direction which is axially and outwardly of the spool in the direction of movement of the wire being uncoiled. The wire being uncoiled from the spool engages the bent ends of the filaments.

4 Claims, 3 Drawing Figures

WIRE CONTROL MECHANISM

SUMMARY OF THE INVENTION

This invention is concerned with an apparatus for maintaining tension of a moving wire, particularly a wire that is uncoiled over the axial end of a spool of wire.

Discs with radially extending resilient filaments have been used to apply a resistance or impedance to a wire as it is uncoiled from the spool. The wire engages and bends the filaments of the disc as it moves around the end of the spool. As the speed of uncoiling increases, the frictional engagement between the wire and the filaments increases and tension on the wire becomes greater.

Problems have been encountered during the uncoiling of fine gauge wire such as wire having a thickness in the range of 40 to 50 AWG and finer because the disc filaments, due to their thickness and resilience, provide too much tension or impedance during the high speed uncoiling of the wire, especially high speed uncoiling when the wire is subjected to high rates of acceleration and deceleration. High rates of acceleration and deceleration of the wire may occur where coils or similar objects with non-cylindrical cross-sections are being wound.

The apparatus of this invention provides a constant tension on uncoiling wire without requiring any adjustable or moving parts. The apparatus maintains a constant tension even though the wire is uncoiled at high speeds and is subjected to high rates of acceleration and deceleration.

Other advantages of this invention may be found in the following specification, claims and drawings.

BRIEF DESCRIPTION OF THE DRAWINGS

The invention is illustrated more or less diagrammatically in the following drawings wherein.

DESCRIPTION OF THE PREFERRED EMBODIMENTS

Figure 1:
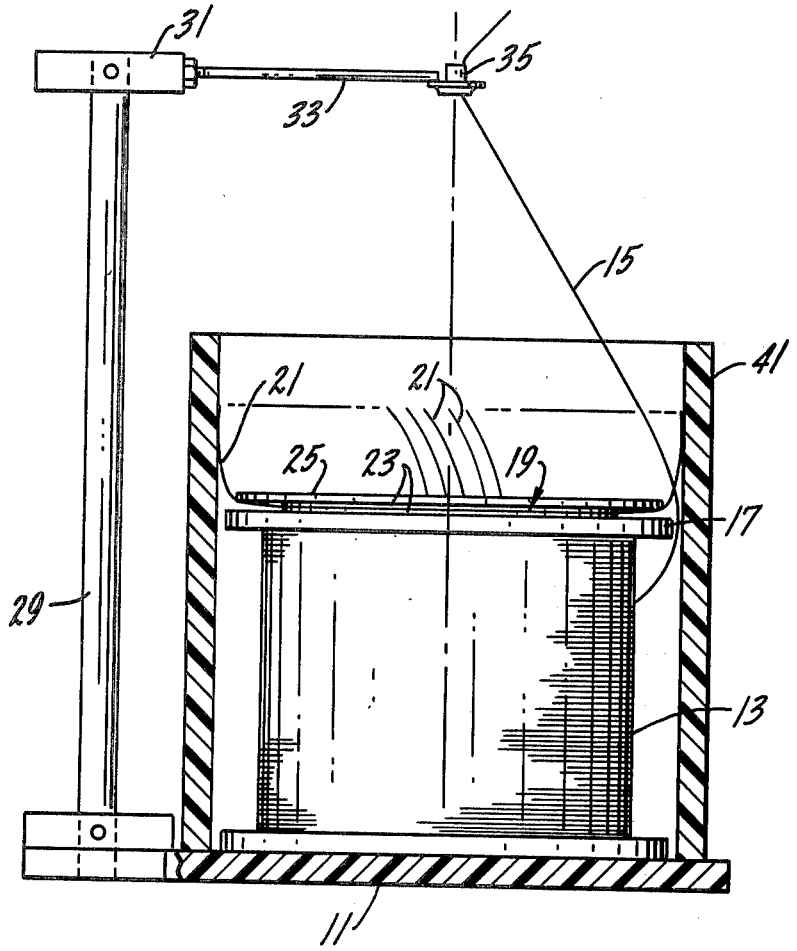
FIG. 1 is a side elevational view, partially in cross-section, of an apparatus embodying the novel feature of this invention.
Figure 2:
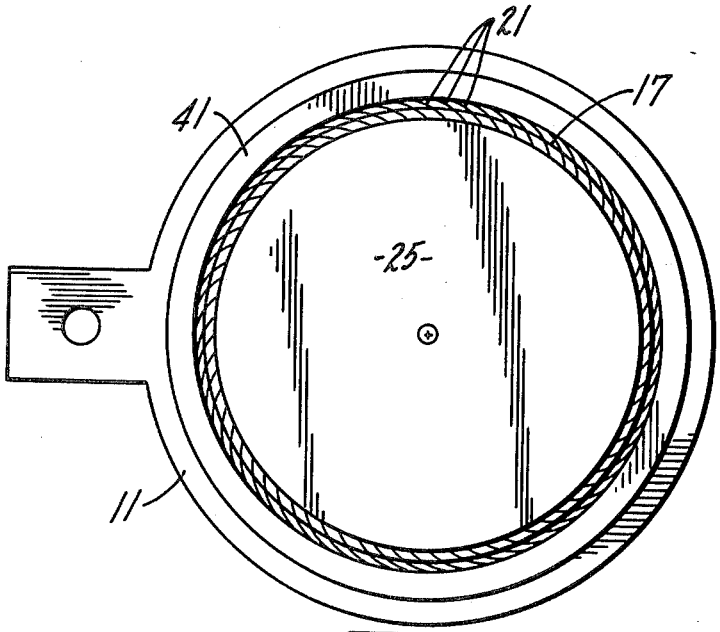
FIG. 2 is a top plan view of the apparatus of FIG. 1.

One form of apparatus embodying the novel features of this invention is shown in FIGS. 1 and 2 of the drawings. The apparatus includes a base 11 on which is positioned a wire spool 13. Although the drawings show the spool in an upright position, it should be understood that it could also be mounted on a base in horizontal alignment or at any convenient angle between the horizontal and the vertical. The spool is mounted on the base so that it does not rotate as the wire 15 is uncoiled over one of the spool flanges 17 at an axial end of the spool.

Mounted on the spool flange 17 which is at the upper end of the spool, as shown in the drawings, is a circular disc 19 having a plurality of resiliently flexible filaments 21 extending radially therefrom. Preferably, each filament is a monofilament of a material such as nylon although other materials such as stainless steel may be suitable for use as filaments. The filaments are sufficiently long so they extend well beyond the periphery of the spool flange. The circular disc 19 is fastened to the spool flange 17 so it does not rotate relative to the spool. As is conventional, the circular disc is formed of a pair of spaced paperboard discs 23 with one disc positioned on each side of the filaments and adhered thereto. A disc 25 is positioned on top of the circular disc 19. This disc has a diameter greater than that of the paperboard disc 23 but less than that of the spool flange 17.

A support post 29 is located outwardly of and extends alongside of the wire spool 13. A block 31 is fastened at the outer end of this post. Arm 33 extending cantileverly from the block and supports an eyelet 35 which is generally aligned with the axis of the spool 13.

An elongated cylindrical tube 41 is mounted on the base surrounding the wire spool 13. This tube may conveniently be made of plastic or some other suitable material and preferably may be transparent. The inner diameter of the tube is greater than that of the spool flanges 17 but less than the diameters of the filaments 21. The filaments of the circular disc 19 are arranged so that the ends of the filaments which engage the cylindrical tube are bent to extend axially and outwardly of the spool in the direction that the wire is uncoiled from the wire spool. The filaments can be bent in this manner by lowering the spool of wire with a filament disc mounted on the top flange thereof into the cylindrical tube.

Figure 3:
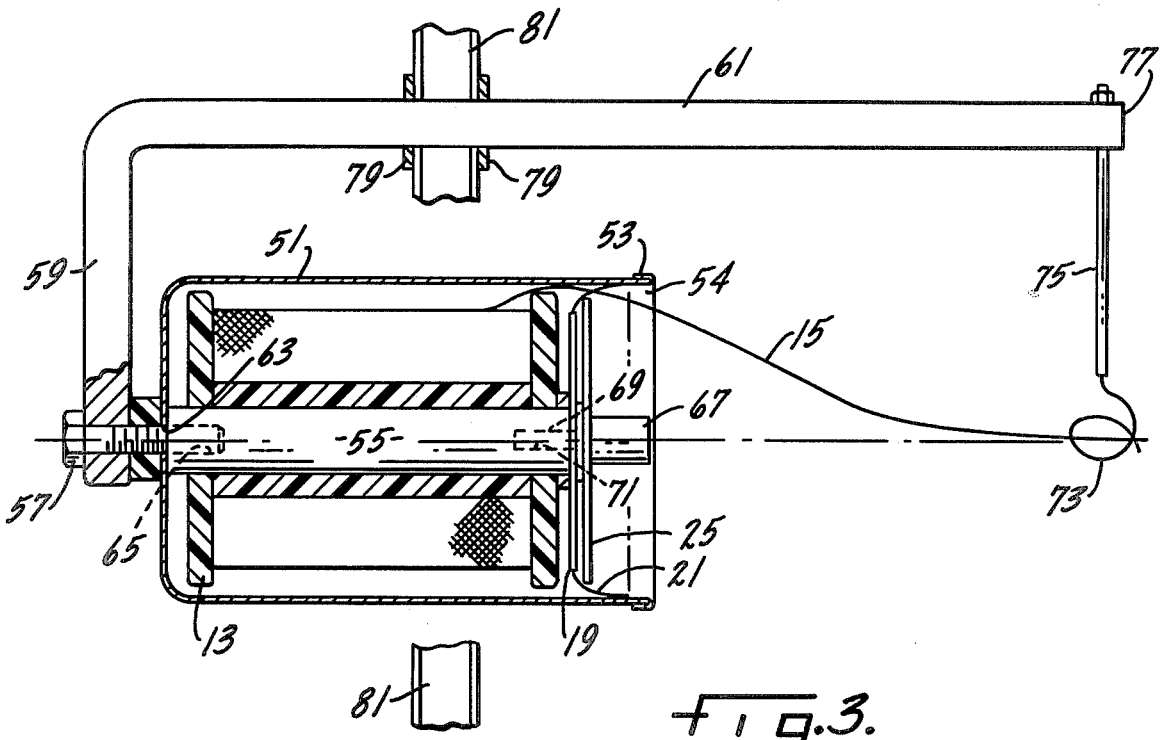
FIG. 3 is a side elevational view, partially in cross-section, of a modified form of the invention.

Another form of apparatus embodying the novel features of this invention is shown in FIG. 3 of the drawings. This alternate embodiment includes a container 51 for the wire spool 13. The container 51 may be conveniently formed of drawn or spun aluminum having a rolled edge or lip 53 at its outlet 54. A wire spool supporting post 55 is axially mounted in the container 51 and is held by a threaded fastener 57 which is mounted near the end of an arm 59 of an L-shaped container support bar 61. The threaded fastener 57 extends through an opening 63 in the base of the container and engages a threaded bore 65 in the base of the post 55 thereby fastening both the container 51 and the spool supporting post 55 to the support bar 61.

A filament disc 19 is mounted on the end of the post 55 adjacent the outlet 54 of the container 51. A disc 25, preferably of metal, is mounted over the filament disc 19 and both are held in place against the spool 13 and the post 55 by a cylindrical shaped fastener 67 having a threaded rod 69 at one end which engages a threaded bore 71 in the post 55 to hold the wire spool 13, filament disc 19 and metal disc 25 in position in the container 51. The discs 19 and 25 are located axially inwardly of the outlet 54 of the container 51 so that the filaments 21 are bent to extend axially and outwardly of the container in the direction that the wire is uncoiled from the wire spool by engagement with the inner surface of the container 51.

A wire guide loop 73 is mounted on a rod 75 fastened to the end 77 of the container support bar 61 in front of the outlet 54 of the container 51. The wire guide loop 73 is ceramic coated to reduce wear and the loop is aligned with the axis of the wire spool 13. The container support bar 61 is supported on cross-bars 79 of a frame 81.

The use, operation and function of this invention are as follows:

The wire 15 which is to be uncoiled from the spool 13 is pulled between the upper flange 17 of the spool and the inner surface of the cylindrical tube 41. When so positioned, the wire will pass between and engage the bent ends of the filaments 21. The wire is then threaded through the eyelet 35 and lead to a suitable winding device. If desired, the wire may also then be extended through a tension indicating device.

As the wire 15 is unwound from the reel 13, it will engage the axially bent ends of the filaments 21 and bend them circumferentially in the direction of uncoiling of the wire, which in this example, is counterclockwise as is shown in FIG. 2. As the wire 15 is uncoiled at high speed, it may contact and ride around the inner surface of the cylindrical tube while also contacting the outer surfaces of the bent ends of the filaments. The apparatus provides an almost constant tension even though the speed of the wire may vary. Also, the filaments will reverse their direction of bending automatically if the wire is uncoiled in the opposite rotational direction.

The apparatus shown in FIG. 3 of the drawings is intended to be installed with the wire spool 13 and its container 51 in a horizontal position. As the wire is uncoiled from the spool, it is pulled between the flange 17 of the spool and the inner surface of the container 51. The wire passes through and engages the bent ends of the filaments 21. The wire is then threaded through the wire guide loop 73 and led to a suitable winding device. If desired, the wire may also then be extended through a tensioning indicating device.

As the wire 15 is unwound from the reel 13, it will engage the axially bent ends of the filaments 21 and also bend them circumferentially in the direction of the uncoiling of the wire. As the wire 15 is uncoiled at high speed, it may contact and ride around the inner surface of the container 51 while also contacting the outer surfaces of the bent ends of the filaments. The apparatus provides an almost constant tension even though the speed of the wire may vary. The apparatus also prevents the wire from falling out of the horizontally aligned container as the speed of the wire increases and decreases.

The relative dimensions of the various parts of this invention can be varied as necessary for each installation. For example, the ratio of the diametric lengths of the filaments 21 to the internal diameters of the tubular member 41 or container 61 may be varied in accordance with the gauge of the wire 15 and the speed of uncoiling of the wire. It may also be desirable to vary the ratio of the diameter of the disc 25 to the diametric length of the filaments 21 to thereby change the amount of bending of their ends. The material and thickness of the filaments may also be varied in accordance with the installation. Although a nylon monofilament is preferred, steel spring wire may also be used for the filament. These and other changes may be made without departing from the teachings of this invention.

I claim:

1. A wire control mechanism including:

a disc adapted to be mounted on an axial end of a spool of wire, said disc having a plurality of radially extending resilient filaments that protrude beyond the periphery of the axial end of the spool of wire, said filaments engaging the wire as it is uncoiled from the spool over the axial end of the spool to thereby apply a resistance to the uncoiling of said wire, and means encircling said disc and engaging the free ends of said filaments to bend said filaments so that they extend axially of said spool in the direction of uncoiling movement of the wire, said wire passing between said encircling means and the bent ends of said filaments and engaging said filaments to apply a resistance to said wire as it is uncoiled over the axial end of said spool.

2. The wire control mechanism of claim 1 in which said means encircling said disc and engaging and bending the free ends of said filaments is a generally cylindrical tube.

3. The wire control mechanism of claim 2 in which the diameter of the filaments of said disc is greater than the inner diameter of said tube.

4. The wire control mechanism of claim 1 in which said means encircling said disc contacts the wire as it is uncoiled over the axial end of said spool.

* * * * *